US008427053B2

(12) United States Patent
Tsujita et al.

(10) Patent No.: US 8,427,053 B2
(45) Date of Patent: Apr. 23, 2013

(54) PLASMA DISPLAY PANEL HAVING HIGH LUMINANCE DISPLAY AND CAPABLE OF BEING DRIVEN WITH LOW VOLTAGE

(75) Inventors: Takuji Tsujita, Osaka (JP); Jun Hashimoto, Osaka (JP); Ryuichi Murai, Osaka (JP); Hiroyuki Kado, Osaka (JP); Masashi Gotou, Osaka (JP); Yukihiro Morita, Osaka (JP); Yasuyuki Noguchi, Hyogo (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/745,375

(22) PCT Filed: Sep. 28, 2009

(86) PCT No.: PCT/JP2009/004919

§ 371 (c)(1),
(2), (4) Date: May 28, 2010

(87) PCT Pub. No.: WO2010/035493

PCT Pub. Date: Apr. 1, 2010

(65) Prior Publication Data

US 2010/0308721 A1 Dec. 9, 2010

(30) Foreign Application Priority Data

Sep. 29, 2008 (JP) ..... 2008-250126

(51) Int. Cl.
*H01J 17/49* (2012.01)

(52) U.S. Cl.
USPC ..... 313/586; 313/582; 313/587

(58) Field of Classification Search ..... 313/582–587
See application file for complete search history.

(56) References Cited

U.S. PATENT DOCUMENTS 6,242,864 B1 6/2001 Nakahara et al.
2002/0121861 A1 9/2002 Katou et al.
(Continued)

FOREIGN PATENT DOCUMENTS

EP 2 031 629 3/2009
JP 8-236028 9/1996
(Continued)

OTHER PUBLICATIONS

International Search Report issued Nov. 10, 2009 in International (PCT) Application No. PCT/JP2009/004919.

(Continued)

*Primary Examiner* — Joseph L Williams
(74) *Attorney, Agent, or Firm* — Wenderoth, Lind & Ponack, L.L.P.

(57) ABSTRACT

A plasma display panel has high definition, high luminance, and low power consumption. In the plasma display panel, the front panel is provided thereon with display electrodes, a dielectric layer, and a protective layer. The display electrodes are formed on the front glass substrate. The dielectric layer coats the display electrodes, and the protective layer is formed on the dielectric layer. The rear panel is provided thereon with address electrodes and barrier ribs for partitioning the discharge space in the direction crossing to the display electrodes. The front and rear panels are opposed to each other with a discharge space therebetween filled with a discharge gas. The protective layer on the dielectric layer includes an underlying film, and aggregated particles adhered on the underlying film, the aggregated particles being formed by aggregating crystal grains of magnesium oxide. The underlying film contains metal oxides composed of at least two oxides selected from magnesium oxide, calcium oxide, strontium oxide, and barium oxide. According to an X-ray diffraction analysis of the surface of the underlying film, in a specific plane direction, the metal oxides have a diffraction angle peak between the minimum and maximum diffraction angles of simple substances of the oxides composing the metal oxides.

1 Claim, 5 Drawing Sheets

U.S. PATENT DOCUMENTS

| | | | | |
|---|---|---|---|---|
| 2006/0012721 | A1* | 1/2006 | Morita et al. | 348/739 |
| 2009/0096375 | A1* | 4/2009 | Yamashita et al. | 313/582 |
| 2009/0140652 | A1 | 6/2009 | Fukui et al. | |
| 2009/0146566 | A1 | 6/2009 | Fukui et al. | |
| 2009/0167176 | A1 | 7/2009 | Fukui et al. | |
| 2010/0045573 | A1 | 2/2010 | Terauchi et al. | |
| 2010/0327740 | A1* | 12/2010 | Kawarazaki et al. | 313/582 |

FOREIGN PATENT DOCUMENTS

| | | | |
|---|---|---|---|
| JP | 10-334809 | | 12/1998 |
| JP | 11-339665 | | 12/1999 |
| JP | 2002-260535 | | 9/2002 |
| JP | 2006-59779 | | 3/2006 |
| JP | 2008-112745 | | 5/2008 |
| JP | 2009-129616 | | 6/2009 |
| WO | 2007/139184 | | 12/2007 |
| WO | WO 2007139183 | A1 * | 12/2007 |
| WO | 2008/047910 | | 4/2008 |

OTHER PUBLICATIONS

European Office Action issued Jul. 26, 2011 in corresponding Application No. 09 812 474.6.

* cited by examiner

PLASMA DISPLAY PANEL HAVING HIGH LUMINANCE DISPLAY AND CAPABLE OF BEING DRIVEN WITH LOW VOLTAGE

TECHNICAL FIELD

The present invention relates to a plasma display panel used in display devices and the like.

BACKGROUND ART

Plasma display panels (hereinafter, PDPs), which are characterized by high definition and large screen size, have been commercialized as 100 inch class televisions and other products. In recent years, PDPs are planned to be used in high-definition televisions having more than double the number of scan lines than conventional NTSC televisions. There is also an increasing demand for lower power consuming and lead-free PDPs in terms of energy and environmental issues.

A PDP basically includes a front panel and a rear panel. The front panel includes a glass substrate, display electrodes, a dielectric layer, and a protective layer. The glass substrate is a sodium borosilicate glass produced by a float process. The display electrodes consist of transparent electrodes and bus electrodes arranged in a stripe pattern on a main surface of the glass substrate. The dielectric layer coats the display electrodes and functions as a capacitor. The protective layer is made of magnesium oxide (MgO) and formed on the dielectric layer.

The rear panel, on the other hand, includes a glass substrate, address electrodes, an underlying dielectric layer, barrier ribs, and phosphor layers. The address electrodes are arranged in a stripe pattern on a main surface of the glass substrate. The underlying dielectric layer coats the address electrodes. The barrier ribs are formed on the underlying dielectric layer. The phosphor layers, which emit red, green, and blue light, are formed between the barrier ribs.

The front and rear panels are air-tight sealed with their electrode bearing sides opposed to each other, and have a discharge space partitioned by barrier ribs and filled with a discharge gas of neon (Ne) and xenon (Xe) at a pressure of 400 to 600 Torr (50000 to 80000 Pa). In the PDP, the display electrodes are discharged by selectively applying a video signal voltage thereto, and the discharge generates ultraviolet light, which excites and illuminates the red, green, and blue phosphor layers, thus achieving color image display.

A general method for driving such a PDP includes an initializing period, an address period, and a sustain period. In the initializing period, wall charges are adjusted to facilitate an address discharge. In the address period, an address discharge is generated according to an input image signal. In the sustain period, display is performed by generating a sustain discharge in a discharge space in which the address discharge has been generated. These periods are combined to form a period (subfield), which is repeated a plurality of times in a period (one field) corresponding to one image exposure, thereby achieving gradation display of the PDP.

In such a PDP, the role of the protective layer on the dielectric layer of the front panel includes protecting the dielectric layer from ion impact caused by discharge and emitting initial electrons for generating an address discharge. The protection of the dielectric layer from ion impact is important to prevent an increase in the discharge voltage, whereas the emission of initial electrons for generating an address discharge is important to prevent address discharge failure, which results in image flicker.

In order to reduce image flicker by emitting a larger number of initial electrons from the protective layer, it has been suggested to make a magnesium oxide (MgO) protective layer have impurities therein or have magnesium oxide (MgO) particles thereon (see, for example, Patent Literature 1, 2, 3, 4, and 5).

Televisions are becoming higher in definition in recent years, and there is a growing demand on the market for low-cost full HD (high-definition) PDPs having high resolution (1920×1080 pixels: progressive display), low power consumption, and high luminance. It is extremely important to control the electron emission performance of the protective layer because it determines the image quality of the PDPs.

Displaying higher definition images requires a larger number of pixels to be addressed although one field time is the same, thereby requiring that a pulse to be applied to the address electrodes in the address period of each subfield should have a smaller width. However, there is a time lag called a "discharge delay" after a voltage pulse rises and until a discharge occurs in the discharge space. As a result, the small pulse width provides a low probability of completing the discharge in the address period, thereby reducing image quality such as lighting failures and flickers.

In order to improve the efficiency of emission caused by discharge so as to achieve lower power consumption, it is possible to increase the xenon (Xe) partial pressure. This, however, increases the discharge voltage and the discharge delay, thus reducing the image quality such as lighting failures.

Thus, providing a PDP with higher definition and lower power consumption requires maintaining a low discharge voltage, and at the same time, preventing lighting failures so as to keep high image quality.

The approach of improving electron emission performance by adding impurities to the protective layer, however, causes electric charges to decrease at a higher rate when accumulated on the protective layer surface so as to be used as memory. This requires, for example, increasing the applied voltage to compensate such a decrease in the electrification.

In the approach of providing magnesium oxide (MgO) crystal grains on the magnesium oxide (MgO) protective layer, on the other hand, lighting failures can be reduced by reducing the discharge delay, but the discharge voltage cannot be reduced.

In view of these problems, the present invention has an object of providing a PDP having high luminance display and capable of being driven with a low voltage.

Patent Literature 1: Japanese Patent Unexamined Publication No. 2002-260535

Patent Literature 2: Japanese Patent Unexamined Publication No. H11-339665

Patent Literature 3: Japanese Patent Unexamined Publication No. 2006-59779

Patent Literature 4: Japanese Patent Unexamined Publication No. H8-236028

Patent Literature 5: Japanese Patent Unexamined Publication No. H10-334809

SUMMARY OF THE INVENTION

The PDP according to the present invention includes a first substrate and a second substrate. The first substrate includes a substrate, display electrodes formed on the substrate, a dielectric layer coating the display electrodes, and a protective layer on the dielectric layer. The second substrate includes address electrodes in the direction crossing to the display electrode, and barrier ribs partitioning the discharge space. The second substrate is opposed to the first substrate in such a manner that the first substrate includes a discharge space filled with a discharge gas. The protective layer on the dielectric layer of the first substrate includes an underlying film, and aggregated particles adhered on the underlying film, the aggregated particles being formed by aggregating crystal grains of magnesium oxide. The underlying film is made of metal oxides composed of at least two oxides selected from magnesium oxide, calcium oxide, strontium oxide, and barium oxide. According to an X-ray diffraction analysis of the surface of the underlying film, in a specific plane direction, the metal oxides have a diffraction angle peak between the minimum and maximum diffraction angles of simple substances of the oxides composing the metal oxides.

This structure allows a PDP to have excellent characteristics of secondary electron emission of the protective layer so as to have a low starting voltage and a low discharge delay, causing no lighting failures or other problems even when the discharge gas has a high xenon (Xe) partial pressure to increase the luminance, thereby having high definition image display.

DETAILED DESCRIPTION OF PREFERRED EMBODIMENT

The PDP according to an embodiment of the present invention will be described as follows with reference to drawings.

Exemplary Embodiment

Figure 1:
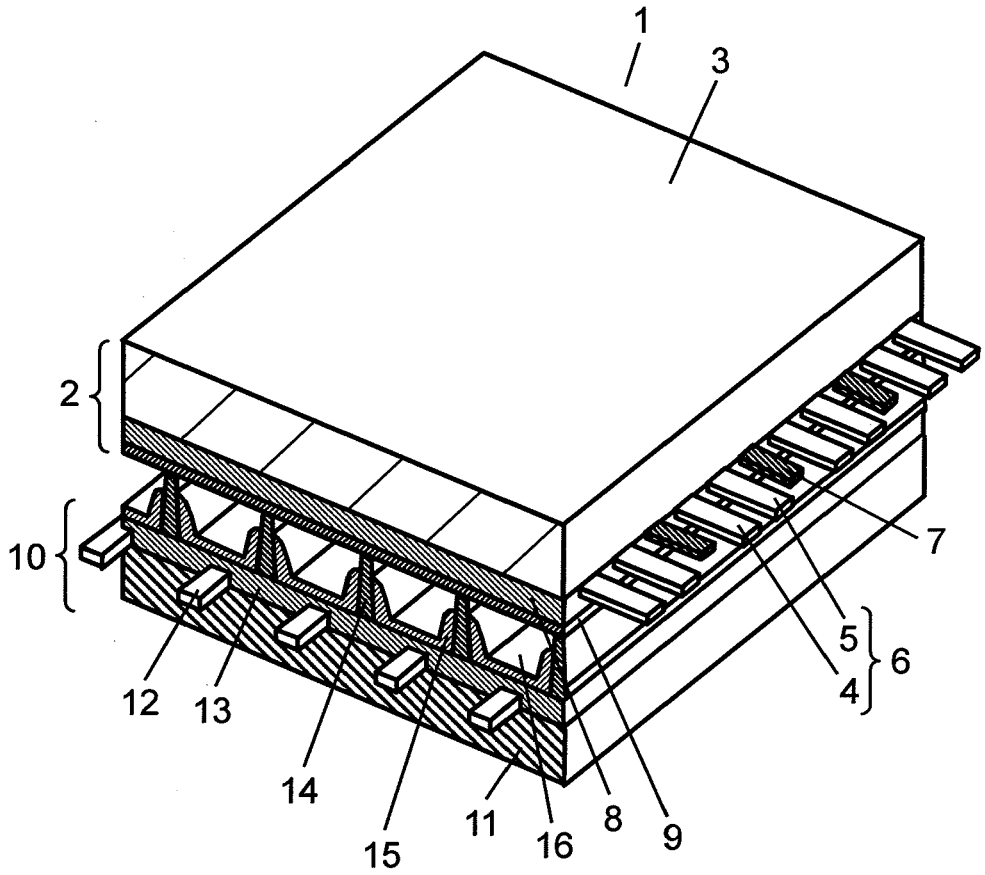
FIG. 1 is a perspective view of a PDP according to an exemplary embodiment of the present invention.

FIG. 1 is a perspective view of PDP 1 according to an exemplary embodiment of the present invention. PDP 1 has the same basic structure as general AC surface-discharge type PDPs. As shown in FIG. 1, PDP 1 includes a first substrate (hereinafter, front panel 2) including front glass substrate 3, and second substrate (hereinafter, rear panel 10) including rear glass substrate 11. These panels 2 and 10 are opposed to each other so as to air-tight seal their outer peripheries with a sealing member such as a glass frit, thereby forming discharge space 16. Discharge space is filled with a discharge gas including xenon (Xe) and neon (Ne) at a pressure of 400 to 600 Torr (53300 to 80000 Pa).

Front glass substrate 3 of front panel 2 includes thereon belt-shaped display electrodes 6 and black stripes (light shielding layers) 7, which are arranged in parallel with each other. Display electrodes 6 each consist of a pair of scan electrode 4 and sustain electrode 5. Front glass substrate 3 further includes dielectric layer 8, and protective layer 9 formed thereon. Dielectric layer 8 coats display electrodes 6 and light shielding layers 7, and holds electric charges to function as a capacitor.

Rear glass substrate 11 of rear panel 10 includes thereon belt-shaped address electrodes 12, and underlying dielectric layer 13, which coats address electrodes 12. Address electrodes 12 are arranged in parallel to each other at right angles to scan electrodes 4 and sustain electrodes 5 of front panel 2. Rear glass substrate 11 further includes barrier ribs 14 of a predetermined height, which are on underlying dielectric layer 13 between address electrodes 12, thereby partitioning discharge space 16. The gaps between barrier ribs 14 are sequentially coated with a phosphor material to form phosphor layers 15 of red, green, and blue. The discharge space is thus formed at the intersections of scan and sustain electrodes 4, 5, and address electrodes 12 so as to form phosphor layers 15 of red, green, and blue arranged in the direction of display electrodes 6, thereby functioning as pixels and achieving color display.

Figure 2:
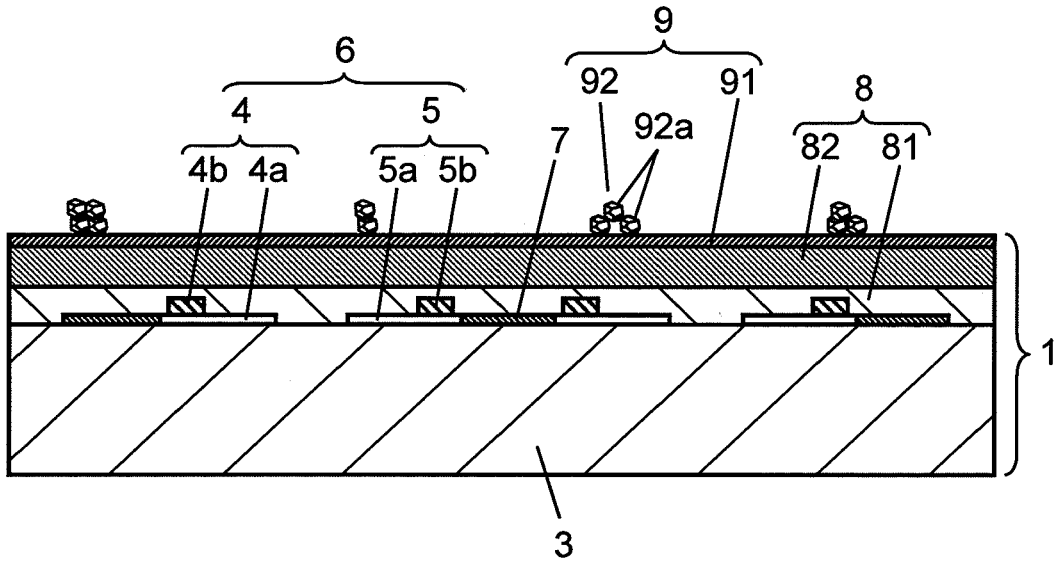
FIG. 2 is a sectional view of a front panel of the PDP.

FIG. 2 is a sectional view of front panel 2 of PDP 1 according to the exemplary embodiment of the present invention. FIG. 2 shows front panel 2 of FIG. 1 upside down. As shown in FIG. 2, light shielding layers 7, and display electrodes 6 consisting of scan electrodes 4 and sustain electrodes 5 are patterned on front glass substrate 3, which has been produced by a float process. Scan electrodes 4 each consist of transparent electrode 4*a* made of indium tin oxide (ITO) or tin oxide ($SnO_2$), and metal bus electrode 4*b* formed on transparent electrode 4*a*. Sustain electrodes 5 each consist of transparent electrode 5*a* made of indium tin oxide (ITO) or tin oxide ($SnO_2$), and metal bus electrode 5*b* formed on transparent electrode 5*a*. Metal bus electrodes 4*b* and 5*b* are made of a conductive material mainly composed of silver (Ag) so as to provide conductivity in the longitudinal direction of transparent electrodes 4*a* and 5*a*.

Dielectric layer 8 includes at least two layers: first dielectric layer 81 and second dielectric layer 82. First dielectric layer 81 coats transparent electrodes 4*a*, 5*a*, metal bus electrodes 4*b*, 5*b*, and light shielding layers 7 formed on front glass substrate 3. Second dielectric layer 82 is formed on first dielectric layer 81. In addition, protective layer 9 is formed on second dielectric layer 82.

Protective layer 9 includes underlying film 91 formed on dielectric layer 8, and aggregated particles 92 formed by aggregating crystal grains 92*a* of magnesium oxide (MgO) on underlying film 91. Underlying film 91 is made of metal oxides composed of at least two oxides selected from magnesium oxide (MgO), calcium oxide (CaO), strontium oxide (SrO), and barium oxide (BaO). Underlying film 91 has aggregated particles 92 adhered thereon, which are formed by aggregating crystal grains 92*a* of magnesium oxide (MgO).

The following is a description of a method for producing PDP 1. First, scan electrodes 4, sustain electrodes 5, and light shielding layers 7 are formed on front glass substrate 3. Transparent electrodes 4*a* and 5*a*, and metal bus electrodes 4*b* and 5*b* of scan and sustain electrodes 4 and 5 are patterned by photolithography. Transparent electrodes 4*a* and 5*a* are formed by a thin film process or the like. Metal bus electrodes 4*b* and 5*b* are formed by sintering and solidifying a paste containing silver (Ag) at a predetermined temperature. Light shielding layers 7 are formed by screen printing a paste containing a black pigment, or by applying a paste containing a black pigment to the entire surface of the glass substrate, patterning the paste by photolithography, and then sintering it.

Next, a dielectric paste is applied by die coating or the like onto scan electrodes 4, sustain electrodes 5, and light shielding layers 7 so as to form a dielectric paste (dielectric material) layer on front glass substrate 3. After applied, the dielectric paste is left for a predetermined time so as to smooth its surface. Then, the resulting dielectric paste layer is sintered and solidified to form dielectric layer 8 coating scan electrodes 4, sustain electrodes 5, and light shielding layers 7. The dielectric paste is a paint containing a dielectric material such as glass powder, a binder, and a solvent.

Next, underlying film 91 is formed on dielectric layer 8. According to the exemplary embodiment of the present invention, underlying film 91 is made of metal oxides composed of at least two oxides selected from magnesium oxide (MgO), calcium oxide (CaO), strontium oxide (SrO), and barium oxide (BaO).

Underlying film 91 is formed by a thin film forming method using a magnesium oxide (MgO) pellet, a calcium oxide (CaO) pellet, a strontium oxide (SrO) pellet, a barium oxide (BaO) pellet, or a mixture pellet of these oxides. Examples of the thin film forming method include electron beam evaporation, sputtering, and ion plating. The practical upper limit of the pressure is considered to be 1 Pa in the case of the sputtering method, and 0.1 Pa in the case of the electron beam evaporation method, which is one of the evaporation methods.

The atmosphere during the formation of underlying film 91 is adjusted while being kept sealed from the outside so as to prevent contact with moisture or impurities. This allows underlying film 91 of metal oxides to have predetermined electron emission characteristics.

The following is a description of aggregated particles 92 formed by aggregating crystal grains 92*a* of magnesium oxide (MgO), which adhere onto underlying film 91. Crystal gains 92*a* can be produced by either the vapor phase synthesis or the precursor sintering method shown below.

In the case of using the vapor phase synthesis, magnesium metal of 99.9% or higher purity is heated in an atmosphere filled with an inert gas, and a small amount of oxygen is added to the atmosphere to directly oxidize magnesium. As a result, crystal grains 92*a* of magnesium oxide (MgO) are produced.

In the case of using the precursor sintering method, on the other hand, crystal grains 92*a* can be produced as follows. A magnesium oxide (MgO) precursor is uniformly sintered at 7000° C. or higher, and annealed to obtain crystal grains 92*a* of magnesium oxide (MgO). The precursor can be at least one compound selected from magnesium alkoxide ($Mg(OR)_2$), magnesium acetylacetone ($Mg(acac)_2$), magnesium hydroxide ($Mg(OH)_2$), magnesium carbonate ($MgCO_2$), magnesium chloride ($MgCl_2$), magnesium sulfate ($MgSO_4$), magnesium nitrite ($Mg(NO_3)_2$), and magnesium oxalate ($MgC_2O_4$). The selected compounds may be in the form of hydrate, which can be used in the same manner.

These compounds are adjusted in such a manner that the sintered magnesium oxide (MgO) has 99.95% or higher purity, and preferably has 99.98% or higher purity. When these compounds contain more than a certain amount of impurity elements such as various alkali metals, boron (B), silicon (Si), iron (Fe), or aluminum (Al), this causes unwanted adhesion between particles or sintering of the particles during the heat treatment, making it difficult to obtain crystal grains 92*a* of highly crystalline magnesium oxide (MgO). This is why the purity of the precursor is previously adjusted, for example, by removing impurity elements.

Crystal gains 92*a* of magnesium oxide (MgO) obtained by either of the above-described methods are dispersed in a solvent. Then, the resulting dispersion liquid is applied onto the surface of underlying film 91 by spraying, screen printing, electrostatic coating, or the like. Then, the dispersion liquid is subjected to a drying and sintering process to remove the solvent, thereby settling aggregated particles 92 formed by aggregating crystal grains 92*a* of magnesium oxide (MgO) on the surface of underlying film 91.

As a result of these processes, predetermined components (scan electrodes 4, sustain electrodes 5, light shielding layers 7, dielectric layer 8, and protective layer 9) are formed on front glass substrate 3 so as to complete front panel 2.

Rear panel 10, on the other hand, is formed as follows. First, a material layer for address electrodes 12 is formed by screen printing a paste containing silver (Ag) on rear glass substrate 11, or forming a metal film on the entire surface of rear glass substrate 11 and then patterning it by photolithography. Then, the material layer is sintered at a predetermined temperature so as to form address electrodes 12. Next, a dielectric paste is applied by die coating or the like onto address electrodes 12 formed on rear glass substrate 11, thereby forming a dielectric paste layer. Then, the dielectric paste layer is sintered to form underlying dielectric layer 13. The dielectric paste is a paint containing a dielectric material such as glass powder, a binder, and a solvent.

Next, a paste containing barrier rib material for forming barrier ribs is applied on underlying dielectric layer 13 and patterned in a predetermined shape, thereby forming a barrier rib material layer. The barrier rib material layer is sintered at a predetermined temperature to form barrier ribs 14. The patterning of the barrier rib paste applied onto underlying dielectric layer 13 can be photolithography or sandblasting. Then, a phosphor paste containing phosphor material is applied onto underlying dielectric layer 13 between adjacent barrier ribs 14 and on the sides of barrier ribs 14, and then sintered, thereby forming phosphor layers 15. As a result of these processes, rear panel 10 having predetermined components is completed on rear glass substrate 11.

Front and rear panels 2 and 10 each including the predetermined components are disposed opposite to each other in such a manner that scan electrodes 4 and address electrodes 12 are arranged at right angles to each other. The peripheries of these panels 2 and 10 are sealed with a glass frit, and discharge space 16 is filled with a discharge gas including xenon (Xe) and neon (Ne), thus completing PDP 1.

The following is a detailed description of first and second dielectric layers 81 and 82 composing dielectric layer 8 of front panel 2. First dielectric layer 81 is made of a dielectric material having the following material composition: 20 to 40 wt % of bismuth oxide ($Bi_2O_3$), 0.5 to 12 wt % of at least one of calcium oxide (CaO), strontium oxide (SrO), and barium oxide (BaO), and 0.1 to 7 wt % of at least one of molybdenum oxide ($MoO_3$), tungsten oxide ($WO_3$), cerium oxide ($CeO_2$), and manganese dioxide ($MnO_2$).

It is possible to replace molybdenum oxide ($MoO_3$), tungsten oxide ($WO_3$), cerium oxide ($CeO_2$), and manganese dioxide ($MnO_2$) by the same amount (0.1 to 7 wt %) of at least one of copper oxide (CuO), chromium oxide ($Cr_2O_3$), cobalt oxide ($Co_2O_3$), vanadium oxide ($V_2O_7$), and antimony oxide ($Sb_2O_3$).

In addition to the above-mentioned components, the dielectric material of first dielectric layer 81 can alternatively have the following lead-free material composition: 0 to 40 wt % of zinc oxide (ZnO), 0 to 35 wt % of boron oxide ($B_2O_3$), 0 to 15 wt % of silicon oxide ($SiO_2$), and 0 to 10 wt % of aluminum oxide ($Al_2O_3$).

The dielectric material having these components is pulverized to a particle diameter of 0.5 to 2.5 μm by a wet-type jet mill or a ball mill so as to produce dielectric material powder.

Then, 55 to 70 wt % of the dielectric material powder and 30 to 45 wt % of the binder component are well kneaded by a three-roll mill, thereby producing a paste for first dielectric layer 81, which can be applied by die coating or printing.

The binder component is ethylcellulose, terpineol containing 1 to 20 wt % of acrylic resin, or butyl carbitol acetate. The paste can be added with a plasticizer or a dispersant according to the need so as to improve the printing characteristics of the paste. Examples of the plasticizer include dioctyl phthalate, dibutyl phthalate, triphenyl phosphate, and tributyl phosphate. Examples of the dispersant include glycerol monooleate, sorbitan sesquioleate, homogenol (trade name, manufactured by Kao Corporation), and a phosphate ester of an alkyl-aryl group.

Next, the paste for the first dielectric layer is applied by die coating or screen printing in such a manner as to coat display electrodes 6 on front glass substrate 3, dried, and then sintered at 575 to 590° C., which is a little higher than the softening point of the dielectric material, thereby forming first dielectric layer 81.

The following is a description of second dielectric layer 82. Second dielectric layer 82 is made of a dielectric material having the following material composition: 11 to 20 wt % of bismuth oxide ($Bi_2O_3$), 1.6 to 21 wt % of at least one of calcium oxide (CaO), strontium oxide (SrO), and barium oxide (BaO), and 0.1 to 7 wt % of at least one of molybdenum oxide ($MoO_3$), tungsten oxide ($WO_3$), and cerium oxide ($CeO_2$).

It is possible to replace molybdenum oxide ($MoO_3$), tungsten oxide ($WO_3$), and cerium oxide ($CeO_2$) by the same amount (0.1 to 7 wt %) of at least one of copper oxide (CuO), chromium oxide ($Cr_2O_3$), cobalt oxide ($Co_2O_3$), vanadium oxide ($V_2O_7$), antimony oxide ($Sb_2O_3$), and manganese oxide ($MnO_2$).

In addition to the above-mentioned components, the dielectric material of second dielectric layer 82 can alternatively have the following lead-free material composition: 0 to 40 wt % of zinc oxide (ZnO), 0 to 35 wt % of boron oxide ($B_2O_3$), 0 to 15 wt % of silicon oxide ($SiO_2$), and 0 to 10 wt % of aluminum oxide ($Al_2O_3$).

The dielectric material having these components is pulverized to a particle diameter of 0.5 to 2.5 μm by a wet-type jet mill or a ball mill so as to produce dielectric material powder. Then, 55 to 70 wt % of the dielectric material powder and 30 to 45 wt % of the binder component are well kneaded by a three-roll mill, thereby producing a paste for the second dielectric layer, which can be applied by die coating or printing. The binder component is ethylcellulose, terpineol containing 1 to 20 wt % of acrylic resin, or butyl carbitol acetate. The paste can be added with a plasticizer or a dispersant according to the need so as to improve the printing characteristics of the paste. Examples of the plasticizer include dioctyl phthalate, dibutyl phthalate, triphenyl phosphate, and tributyl phosphate. Examples of the dispersant include glycerol monooleate, sorbitan sesquioleate, homogenol (trade name, manufactured by Kao Corporation), and a phosphate ester of an alkyl-aryl group.

Next, the paste for the second dielectric layer is applied by screen printing or die coating in such a manner as to coat first dielectric layer 81, dried, and then sintered at 550 to 590° C., which is a little higher than the softening point of the dielectric material.

In order to have high visible light transmittance, dielectric layer 8 preferably has a thickness of 41 μm or less as the total thickness of first and second dielectric layers 81 and 82. To reduce the reaction between the silver (Ag) contained in metal bus electrodes 4*b*, 5*b* and molybdenum oxide ($MoO_3$), tungsten oxide ($WO_3$), cerium oxide ($CeO_2$), and manganese oxide ($MnO_2$) in dielectric layer 8, first dielectric layer 81 has 20 to 40 wt % of bismuth oxide ($Bi_2O_3$), which is larger than in second dielectric layer 82. As a result, first dielectric layer 81 has a lower visible light transmittance than second dielectric layer 82, and hence, has a smaller thickness than second dielectric layer 82.

When having a bismuth oxide ($Bi_2O_3$) content of 11 wt % or less, second dielectric layer 82 is less colored, but unpreferably produces bubbles more easily. When having a bismuth oxide ($Bi_2O_3$) content exceeding 40 wt %, on the other hand, second dielectric layer 82 is colored more easily, and has lower transmittance.

The thickness of dielectric layer 8 is preferably as small as possible within the range of not causing a decrease in the isolation voltage. This is because the smaller the thickness of dielectric layer 8, the more remarkable the effect of improving luminance and reducing the discharge voltage is. From this viewpoint, according to the exemplary embodiment of the present invention, the thickness of dielectric layer 8 is set to 41 μm or less, and the thicknesses of first and second dielectric layers 81 and 82 are set to 5 to 15 μm, and 20 to 36 μm, respectively.

It has been confirmed that, in PDP 1 thus produced, using silver (Ag) in display electrodes 6 hardly causes front glass substrate 3 to be colored (yellowed) or dielectric layer 8 to produce bubbles, allowing dielectric layer 8 to provide excellent isolation voltage performance.

In PDP 1 according to the exemplary embodiment of the present invention, these dielectric materials can prevent first dielectric layer 81 from yellowing or producing bubbles because of the following reason. It is known that adding molybdenum oxide ($MoO_3$) or tungsten oxide ($WO_3$) to dielectric glass containing bismuth oxide ($Bi_2O_3$) makes it easier to generate compounds such as $Ag_2MoO_4$, $Ag_2Mo2O_7$, $Ag_2Mo_4O_{13}$, $Ag_2WO_4$, $Ag_2W_2O_7$, or $Ag_2W_4O_{13}$ at low temperatures of 580° C. or below. Since dielectric layer 8 is sintered at 550 to 590° C. in the exemplary embodiment of the present invention, the silver ions (Ag+) dispersed in dielectric layer 8 during the sintering react with molybdenum oxide ($MoO_3$), tungsten oxide ($WO_3$), cerium oxide ($CeO_2$), and manganese oxide ($MnO_2$) in dielectric layer 8, thereby generating stable compounds. In other words, the silver ions (Ag+) are not aggregated into colloidal particles because they are stabilized without being reduced. The stabilized silver ions (Ag+) reduce the generation of oxygen caused by the colloided silver (Ag), thereby reducing the occurrence of bubbles in dielectric layer 8.

To make good use of the effects of preventing yellowing and bubbling, the dielectric glass containing bismuth oxide ($Bi_2O_3$) preferably has 0.1 wt % or more of molybdenum oxide ($MoO_3$), tungsten oxide ($WO_3$), cerium oxide ($CeO_2$), and manganese oxide ($MnO_2$), and more preferably, 0.1 to 7 wt % of them. When the contents are less than 0.1 wt %, yellowing cannot be sufficiently prevented, and when the contents exceed 7 wt %, the glass is colored unpreferably.

More specifically, in dielectric layer 8 of PDP 1 according to the exemplary embodiment of the present invention, first dielectric layer 81, which is in contact with metal bus electrodes 4*b* and 5*b* made of silver (Ag), is prevented from yellowing and bubbling. Second dielectric layer 82 on first dielectric layer 81 provides high light transmittance. As a result, the PDP has dielectric layer 8 hardly causing bubbles or yellowing, and having high transmittance.

The following is a detailed description of protective layer 9 according to the exemplary embodiment of the present invention.

In the PDP according to the exemplary embodiment of the present invention, as shown in FIG. 2, protective layer 9 includes underlying film 91 formed on dielectric layer 8, and aggregated particles 92 formed by aggregating crystal grains 92*a* of magnesium oxide (MgO) on underlying film 91. Underlying film 91 is made of metal oxides composed of at least two oxides selected from magnesium oxide (MgO), calcium oxide (CaO), strontium oxide (SrO), and barium oxide (BaO). According to an X-ray diffraction analysis of the surface of underlying film 91, in a specific plane direction, the metal oxides have a diffraction angle peak between the minimum and maximum diffraction angles of simple substances of the oxides composing the metal oxides.

Figure 3:
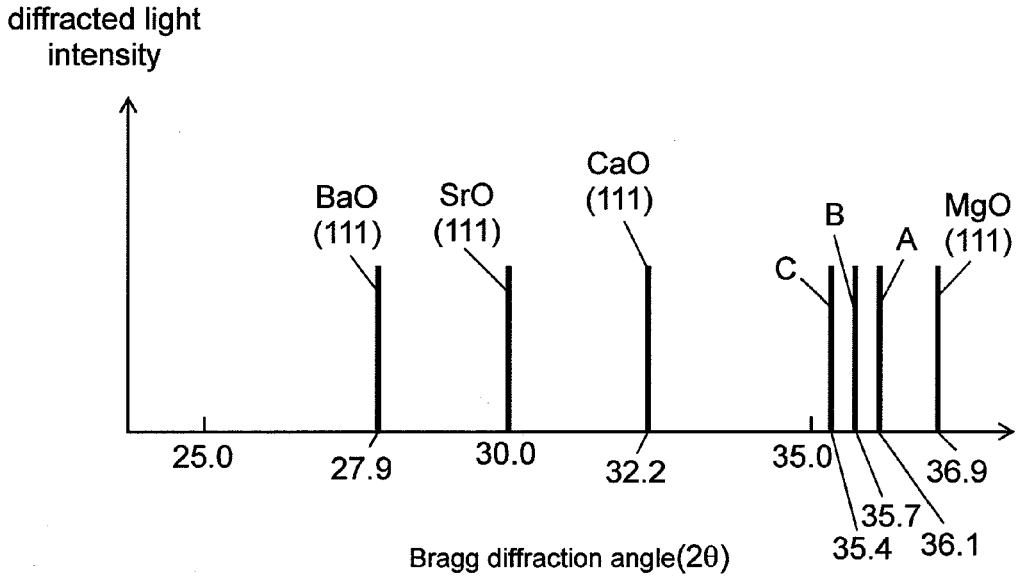
FIG. 3 shows X-ray diffraction results of an underlying film used in the PDP.

FIG. 3 shows the results of X-ray diffraction analysis of the surface of underlying film 91 of protective layer 9 of PDP 1 according to the exemplary embodiment of the present invention. FIG. 3 also shows the results of X-ray diffraction analysis of simple substances of magnesium oxide (MgO), calcium oxide (CaO), strontium oxide (SrO), and barium oxide (BaO).

In FIG. 3, the horizontal axis represents Bragg diffraction angle (2θ), and the vertical axis represents the intensity of X-ray diffracted waves. The diffraction angle is represented by degrees ranging from 0 to 360, and the intensity is represented by an arbitrary unit. Crystal plane directions, which are specific plane directions, are shown in parentheses. As shown in FIG. 3, in the (111) crystal plane direction, a simple substance of calcium oxide (CaO) has a diffraction angle peak at 32.2 degrees, a simple substance of magnesium oxide (MgO) has a diffraction angle peak at 36.9 degrees, a simple substance of strontium oxide has a diffraction angle peak at 30.0 degrees, and a simple substance of barium oxide has a diffraction angle peak at 27.9 degrees.

In PDP 1 according to the exemplary embodiment of the present invention, underlying film 91 of protective layer 9 is made of metal oxides composed of at least two oxides selected from magnesium oxide (MgO), calcium oxide (CaO), strontium oxide (SrO), and barium oxide (BaO).

The results of the X-ray diffraction analysis of FIG. 3 indicate the case where underlying film 91 is made of simple substances of two oxides. More specifically, the X-ray diffraction results of underlying film 91 made of simple substances of magnesium oxide (MgO) and calcium oxide (CaO) are shown as a point "A". The X-ray diffraction results of underlying film 91 made of simple substances of magnesium oxide (MgO) and strontium oxide (SrO) are shown as a point "B". The X-ray diffraction results of underlying, film 91 made of simple substances of magnesium oxide (MgO) and barium oxide (BaO) are shown as a point "C".

The point "A" represents a diffraction angle peak of 36.1 degrees, which is between the maximum diffraction angle of 36.9 degrees and the minimum diffraction angle of 32.2 degrees of simple substances of the oxides in the (111) crystal plane direction as the specific plane direction. The maximum diffraction angle of 36.9 degrees is the diffraction angle of a simple substance of magnesium oxide (MgO) and the minimum diffraction angle of 32.2 degrees is the diffraction angle of a simple substance of calcium oxide (CaO). Similarly, the points "B" and "C" represent diffraction angle peaks of 35.7 degrees and 35.4 degrees, respectively, between the minimum and maximum diffraction angles.

Figure 4:
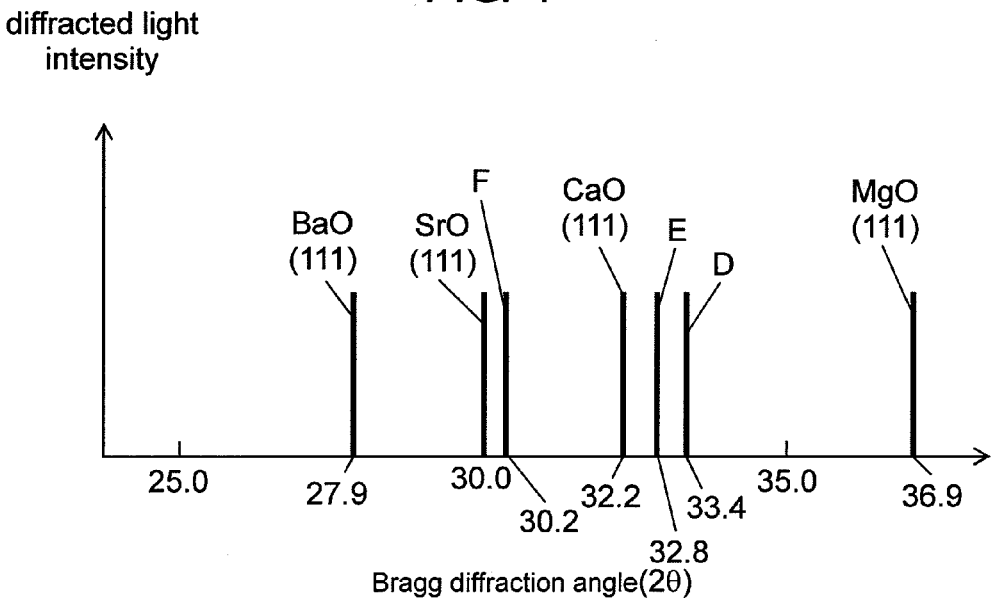
FIG. 4 shows X-ray diffraction results of a differently composed underlying film used in the PDP.

FIG. 4 shows the results of the X-ray diffraction analysis in the case where underlying film 91 is made of simple substances of three oxides. More specifically, the X-ray diffraction results of underlying film 91 made of simple substances of magnesium oxide (MgO), calcium oxide (CaO), and strontium oxide (SrO) are shown as a point "D". The results of underlying film 91 made of simple substances of magnesium oxide (MgO), calcium oxide (CaO), and barium oxide (BaO) are shown as a point "E". The results of underlying film 91 made of simple substances of calcium oxide (CaO), strontium oxide (SrO), and barium oxide (BaO) are shown as a point "F".

The point "D" represents a diffraction angle peak of 33.4 degrees, which is between the maximum diffraction angle of 36.9 degrees and the minimum diffraction angle of 30.0 degrees of simple substances of the oxides in the (111) crystal plane direction as the specific plane direction. The maximum diffraction angle of 36.9 degrees is the diffraction angle of a simple substance of magnesium oxide (MgO) and the minimum diffraction angle of 30.0 degrees is the diffraction angle of a simple substance of strontium oxide (SrO). Similarly, the points "E" and "F" represent diffraction angle peaks of 32.8 degrees and 30.2 degrees, respectively, between the minimum and maximum diffraction angles.

Thus, in PDP 1 according to the exemplary embodiment of the present invention, whether underlying film 91 is made of simple substances of two or three oxides, according to an X-ray diffraction analysis of the surface of underlying film 91, in a specific plane direction, the metal oxides composing underlying film 91 have a diffraction angle peak between the minimum and maximum diffraction angles of simple substances of the oxides composing the metal oxides.

The above description illustrates the case of the (111) crystal plane direction as the specific plane direction; however, the diffraction angle peak of the metal oxides is in the same position in the case where the crystal plane direction is other than (111).

The depth below the vacuum level of calcium oxide (CaO), strontium oxide (SrO), and barium oxide (BaO) is shallower than the depth below the vacuum level of magnesium oxide (MgO). Therefore, the number of electrons emitted by Auger effect when making a transition from the energy level of calcium oxide (CaO), strontium oxide (SrO), and barium oxide (BaO) to the ground state of xenon (Xe) ions while PDP 1 is driven, is considered to be larger than in the case of making a transition from the energy level of magnesium oxide (MgO).

As described above, underlying film 91 in the exemplary embodiment of the present invention has a diffraction angle peak between the minimum and maximum diffraction angles of simple substances of the oxides composing the metal oxides. The metal oxides having the results of X-ray diffraction analysis shown in FIGS. 3 and 4 have energy levels between the energy levels of simple substances of the oxides composing them. This is considered to be the reason that the energy level of underlying film 91 is also between the energy levels of simple substances of the oxides, and the number of electrons emitted by Auger effect is larger than in the case of making a transition from the energy level of magnesium oxide (MgO).

As a result, underlying film 91 can provide better secondary electron emission characteristics than in the case of being made of a simple substance of magnesium oxide (MgO), thereby reducing a discharge sustaining voltage. Therefore, increasing the xenon (Xe) partial pressure in the discharge gas so as to increase the luminance decreases the discharge voltage, thus achieving a PDP having high luminance and capable of being driven with a low voltage.

Table 1 shows the results of the discharge sustaining voltages in the PDP according to the exemplary embodiment of the present invention when a mixture gas (Xe, 15%) of xenon (Xe) and neon (Ne) is filled at a pressure of 450 Torr, and underlying film 91 is made of different materials.

TABLE 1

| | Sample A | Sample B | Sample C | Sample D | Sample E | Comparative Example |
|---|---|---|---|---|---|---|
| discharge sustaining voltage (arb. units) | 90 | 87 | 85 | 81 | 82 | 100 |

The discharge sustaining voltages in Table 1 are expressed as relative values when the discharge sustaining voltage of Comparative Example is 100. In Sample "A", underlying film 91 is made of metal oxides: magnesium oxide (MgO) and calcium oxide (CaO). In Sample "B", underlying film 91 is made of metal oxides: magnesium oxide (MgO) and strontium oxide (SrO). In Sample. "C", underlying film 91 is made of metal oxides: magnesium oxide (MgO) and barium oxide (BaO). In Sample "D", underlying film 91 is made of metal oxides: magnesium oxide (MgO), calcium oxide (CaO), and strontium oxide (SrO). In Sample "E", underlying film 91 is made of metal oxides: magnesium oxide (MgO), calcium oxide (CaO), and barium oxide (BaO). In Comparative Example, underlying film 91 is made of a simple substance of magnesium oxide (MgO).

When the partial pressure of xenon (Xe) of the discharge gas is increased from about 10% to about 15%, the luminance increases by about 30%. When underlying film 91 is made of a simple substance of magnesium oxide (MgO) as in Comparative Example, the discharge sustaining voltage increases by about 10%.

In the PDP according to the exemplary embodiment of the present invention, on the other hand, in all Samples "A", "B", "C", "D", and "E", the discharge sustaining voltage can be reduced by about 10% to about 20% as compared with Comparative Example. As a result, the starting voltage can be in the range of normal operation, thereby achieving a PDP having high luminance and capable of being driven with a low voltage.

When used as simple substances, calcium oxide (CaO), strontium oxide (SrO), and barium oxide (BaO) are highly reactive with impurities, causing a decrease in the electron emission performance. In the exemplary embodiment of the present invention, however, these metal oxides are used together so as to reduce reactivity and to provide a crystal structure with low impurity incorporation or low oxygen deficiency. As a result, when the PDP is driven, the emission of excess electrons is prevented, thereby providing both the capability of being driven with a low voltage and secondary electron emission characteristics, and further providing excellent charge retention performance. The charge retention performance is needed particularly to retain wall charges accumulated in the initializing period and to prevent addressing failures in the address period, thereby securing an address discharge.

The following is a detailed description of aggregated particles 92 formed by aggregating crystal grains 92*a* of magnesium oxide (MgO) on underlying film 91 in the exemplary embodiment of the present invention. The inventors of the present invention have confirmed through experiments that aggregated particles 92 provide the main effect of reducing a discharge delay in the address discharge and improving the temperature dependence of the discharge delay. In other words, aggregated particles 92 have higher characteristics of initial electron emission than underlying film 91. Therefore, in the exemplary embodiment of the present invention, aggregated particles 92 are provided as an initial electron feed section necessary at the rise of a discharge pulse.

When the discharge is started, the initial electrons, which act as a discharge trigger, are emitted into discharge space 16 from the surface of underlying film 91. An insufficient amount of initial electrons seems to be the main cause of the discharge delay, and therefore, to ensure the stable supply of initial electrons, aggregated particles 92 of magnesium oxide (MgO) are dispersed on the surface of underlying film 91. This allows discharge space 16 to be filled with a large number of initial electrons at the rise of the discharge pulse, thereby eliminating the discharge delay. Having such characteristics of initial electron emission enables high definition PDP 1 to be driven at high speed with a high discharge response speed. When provided on the surface of underlying film 91, aggregated particles 92 of magnesium oxide (MgO) provide the main effect of reducing the discharge delay in the address discharge, and improving the temperature dependence of the discharge delay.

As described hereinbefore, PDP 1 according to the exemplary embodiment of the present invention includes underlying film 91 having both the capability of being driven with a low voltage and electric charge retention, and aggregated particles 92 of magnesium oxide (MgO) capable of preventing a discharge delay. This allows PDP 1 to be driven at high speed with a low voltage even when it is a high definition PDP, and to provide high quality image display with few lighting failures.

Figure 5:
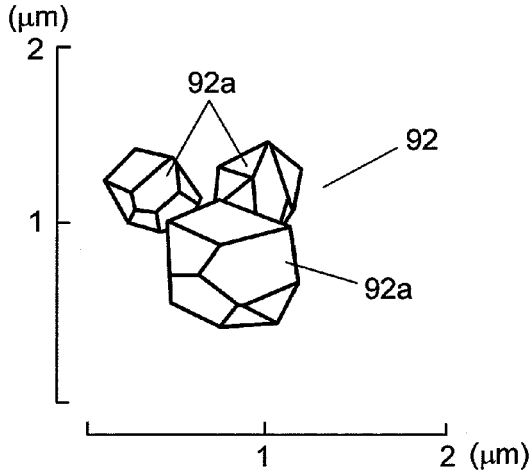
FIG. 5 is an enlarged view of aggregated particles used in the PDP.

In the exemplary embodiment of the present invention, aggregated particles 92, which are aggregated crystal grains 92*a*, are discretely sprayed in such a manner as to be distributed substantially uniformly over the surface of underlying film 91. FIG. 5 is an enlarged view of aggregated particles 92.

As shown in FIG. 5, aggregated particles 92 are crystal grains 92*a* in an aggregated state having a predetermined primary particle diameter. This means that aggregated particles 92 do not have a large bonding strength as solid bodies, but are an assembly of primary particles formed by static electricity or Van der Waals forces. Aggregated particles 92 are bonded with a force corresponding to an ultrasonic wave or other external force that can cause part or all of aggregated particles 92 to be broken down into primary particles. Aggregated particles 92 have a diameter of about 1 μm, and crystal grains 92*a* are preferably in the shape of a polyhedron having seven or more faces such as a truncated octahedron or a dodecahedron.

The primary particle diameter of crystal grains 92*a* can be controlled by controlling the production conditions of crystal grains 92*a*. For example, when crystal grains 92*a* are generated by sintering an MgO precursor such as magnesium carbonate or magnesium hydroxide, the particle diameter can be controlled by controlling sintering temperature or sintering environment. In general, the sintering temperature can be selected within the range of 700 to 1500° C., and when it is 1000° C. or higher, the primary particle diameter can be controlled to 0.3 to 2 μm. When crystal grains 92*a* are obtained by heating the MgO precursor, primary particles are aggregated into crystal grains 92*a* during the production process.

Figure 6:
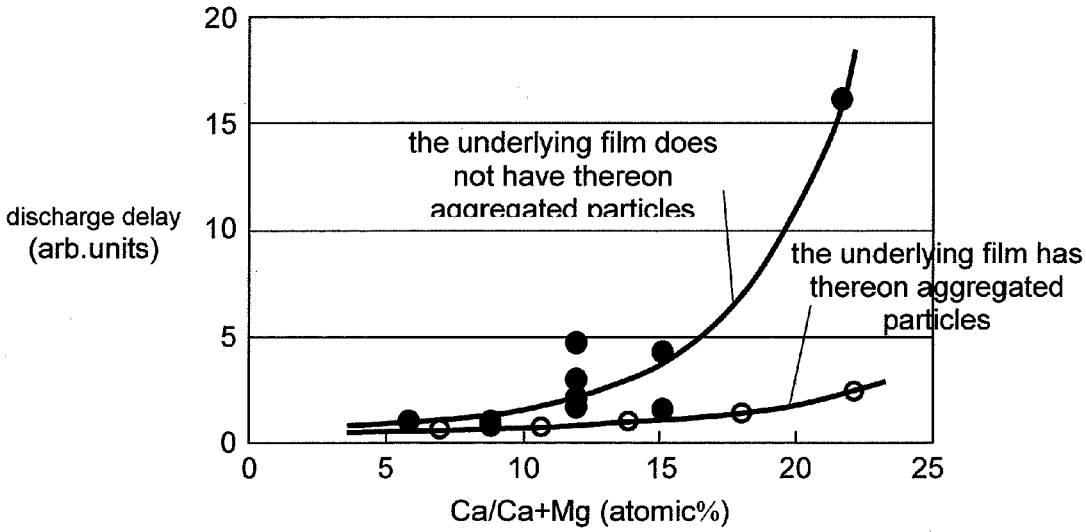
FIG. 6 shows the relationship between the discharge delay and the calcium (Ca) concentration in the protective layer used in the PDP.

FIG. 6 shows the relationship between the discharge delay and the calcium (Ca) concentration in protective layer 9 used in PDP 1 according to the exemplary embodiment of the present invention when underlying film 91 is made of metal oxides: magnesium oxide (MgO) and calcium oxide (CaO). Underlying film 91 is made of metal oxides: magnesium oxide (MgO) and calcium oxide (CaO). According to an X-ray diffraction analysis of the surface of underlying film 91, the metal oxides have a diffraction angle peak between the diffraction angle peaks of magnesium oxide (MgO) and calcium oxide (CaO).

FIG. 6 shows the case where protective layer 9 consists of underlying film 91 only, and the case where protective layer 9 includes aggregated particles 92 on underlying film 91. The amount of the discharge delay is determined with reference to the case where underlying film 91 does not contain calcium (Ca).

As apparent from FIG. 6, in the case of using underlying film 91 only, the discharge delay increases with increasing calcium (Ca) concentration, and in the case of having aggregated particles 92 on underlying film 91, on the other hand, the discharge delay can be very small. FIG. 6 also indicates that an increase in the calcium (Ca) concentration hardly increases the discharge delay.

The following is a description of experimental results conducted to confirm the effect of protective layer 9 including aggregated particles 92 in the exemplary embodiment of the present invention. First, prototypes 1 to 4 of a PDP are produced using different underlying films 91 made of different materials, and aggregated particles 92 formed on underlying films 91. In prototype 1, underlying film 91 is made of magnesium oxide (MgO) only. In prototype 2, underlying film 91 is made of magnesium oxide (MgO) doped with aluminum (Al), silicon (Si), or other impurities. In prototype 3, underlying film 91 is made of magnesium oxide (MgO), and sprayed with magnesium oxide (MgO) crystal grains 92*a* of primary particles.

Prototype 4 is PDP 1 according to the exemplary embodiment of the present invention, and uses the above-mentioned Sample "A" as protective layer 9. As described above, protective layer 9 is formed of underlying film 91, which is made of metal oxides: magnesium oxide (MgO) and calcium oxide (CaO), and aggregated particles 92, which are aggregated crystal grains 92*a*, distributed substantially uniformly over the surface of underlying film 91. According to an X-ray diffraction analysis of the surface of underlying film 91, underlying film 91 has a diffraction angle peak between the minimum and maximum diffraction angles of the simple substances of the oxides composing underlying film 91. In this case, the minimum diffraction angle is 32.2 degrees, which is the diffraction angle of calcium oxide (CaO), and the maximum diffraction angle is 36.9 degrees, which is the diffraction angle of magnesium oxide (MgO). The diffraction angle peak of underlying film 91 is 36.1 degrees.

Figure 7:
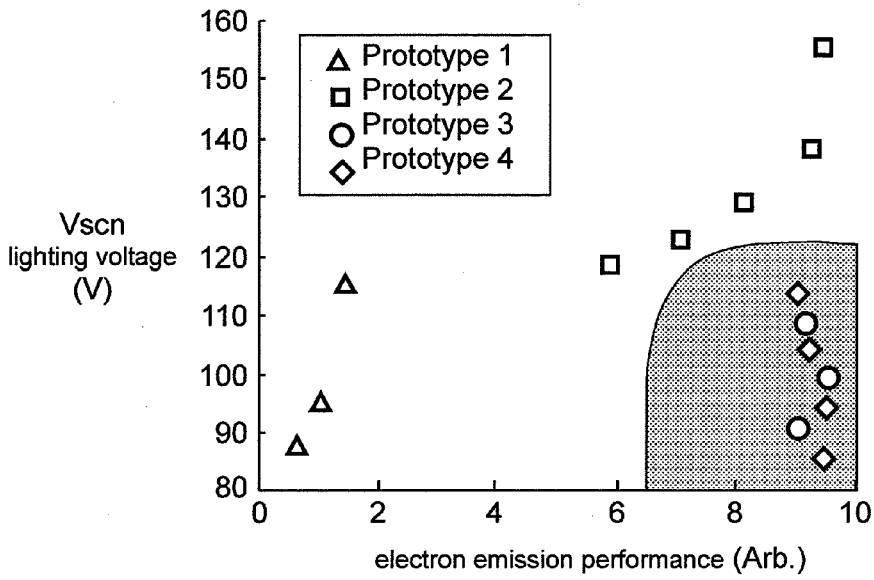
FIG. 7 shows the results of electron emission performance and charge retention performance of the PDP.

These PDP prototypes are examined for their electron emission performance and charge retention performance, and the results are shown in FIG. 7. The electron emission performance represents the amount of electron emission, and is expressed by the amount of initial electron emission, which is determined by the surface condition, the type of gas, and its condition. The amount of initial electron emission can be measured by applying ions or electron beams to the surface of protective layer 9 and measuring the amount of electron current emitted from the surface, but it is difficult to perform a non-destructive evaluation of the surface of front panel 2 of PDP 1. Therefore, the inventors of the present invention have used the method disclosed in Japanese Patent Unexamined Publication No. 2007-48733. More specifically, of various discharge delay times, a value called a statistical delay time is measured, which roughly indicates the ease of the occurrence of discharge. The reciprocal of the value is integrated to obtain a value which linearly corresponds to the amount of initial electron emission.

This is why this value is used to evaluate the surface of front panel 2 of PDP 1. The discharge delay time means the time after a pulse rises and until a discharge occurs. The main cause of the discharge delay is considered that the initial electrons, which act as a discharge trigger at the start of a discharge, are not easily emitted from the surface of protective layer 9 into the discharge space.

A voltage to be applied to the scan electrodes so as to reduce electric charge emission in a PDP (hereinafter, Vscn lighting voltage) is used as an index of charge retention performance. A lower Vscn lighting voltage indicates higher charge retention performance. Having high charge retention performance enables a PDP to use components low in withstand voltage and capacity as a power supply and other electrical parts. In the present products, semiconductor switching elements such as MOSFETs, which apply a scan voltage sequentially to the panels, have a withstand voltage of about 150V. Therefore, the Vscn lighting voltage is preferably 120V or less in consideration of temperature.

FIG. 7 shows the results of electron emission performance and charge retention performance of the PDP according to the exemplary embodiment of the present invention. As apparent from FIG. 7, prototype 4 can have a Vscn lighting voltage of 120V or less in charge retention performance, and can also obtain higher electron emission performance than in the case of using the protective layer containing magnesium oxide (MgO) only. As described earlier, in prototype 4, aggregated particles 92, which are aggregated crystal grains 92*a* of magnesium oxide (MgO), are sprayed uniformly over the surface of underlying film 91 in the exemplary embodiment of the present invention.

In general, the electron emission performance and charge retention performance of the protective layer of a PDP are contradictory. For example, it is possible to increase electron emission performance by changing the conditions of forming the protective layer or by doping impurities such as aluminum (Al), silicon (Si), or barium (Ba) into the protective layer during the formation, but this also increases the Vscn lighting voltage as an adverse effect.

Prototype 4 corresponding to PDP 1 having protective layer 9 according to the exemplary embodiment of the present invention has electron emission performance more than eight times better than prototype 1 using protective layer 9 containing magnesium oxide (MgO) only. Prototype 4 can also provide charge retention performance, which indicates a Vscn lighting voltage of 120V or less. This allows a PDP having a large number of scan lines due to high definition and a small cell size, to provide both electron emission performance and charge retention performance, and to reduce the discharge delay, thereby providing excellent image display quality.

The following is a detailed description of the diameter of aggregated particles 92 used in protective layer 9 of PDP 1 according to the exemplary embodiment of the present invention. In the following description, the particle diameter means an average particle diameter, which means a cumulative volume average diameter (D50).

Figure 8:
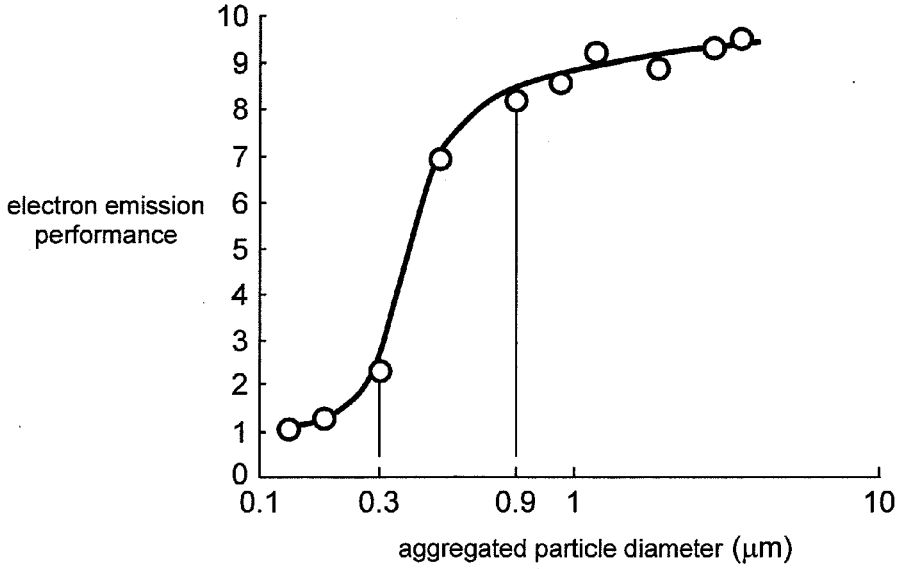
FIG. 8 is a characteristic diagram showing the relationship between the diameter of the crystal grains used in the PDP and the electron emission performance.

FIG. 8 is a characteristic diagram showing experimental results of electron emission performance conducted by changing the diameter of aggregated particles 92 in prototype 4 of the present invention described with FIG. 7. In FIG. 8, the diameter of aggregated particles 92 is measured by SEM observation of aggregated particles 92. FIG. 8 indicates that a small particle diameter such as 0.3 μm reduces the electron emission performance, and an about 0.9 μm or larger particle diameter can provide high electron emission performance.

In order to emit more electrons in the discharge cells, it is preferable to have a larger number of crystal grains 92*a* per unit area of underlying film 91. The inventors of the present invention, however, have conformed through experiments that the presence of aggregated particles 92 at the portions corresponding to the tops of barrier ribs 14 which are in close contact with protective layer 9 damage the tops of barrier ribs 14. They also have conformed that damaged barrier rib material may be put on phosphor layers 15, causing the corresponding cells not to light up or go out normally. Such a damage of barrier ribs is unlikely to occur unless aggregated particles 92 are not present at the portions corresponding to the tops of barrier ribs 14. As a result, the larger the number of aggregated particles 92 to adhere, the higher the probability of occurrence of damage to barrier ribs 14. When the aggregated particles have a diameter as large as 2.5 μm, the probability of occurrence of damage to the barrier ribs increases rapidly. When the aggregated particles have diameters of less than 2.5 μm, on the other hand, the probability of occurrence of damage to the barrier ribs can be comparatively small.

Thus, in PDP 1 according to the exemplary embodiment of the present invention, the above-described effect of the present invention can be obtained by using aggregated particles 92 having particle diameters in the range of 0.9 to 2 μm.

As mentioned above, PDP1 according to the exemplary embodiment of the present invention has high electron emission performance, and a Vscn lighting voltage of 120V or less as charge retention characteristics.

The crystal grains in the exemplary embodiment of the present invention are magnesium oxide (MgO) particles. The same effect can be obtained by using other single crystal grains, for example, metal oxide crystal grains having as high electron emission performance as magnesium oxide (MgO). Examples of such metal oxide crystal grains include strontium oxide (SrO), calcium oxide (CaO), barium oxide (BaO), and aluminum oxide ($Al_2O_3$). Thus, the type of the particles is not limited to magnesium oxide (MgO).

INDUSTRIAL APPLICABILITY

As described hereinbefore, the present invention provides a useful PDP with high image quality and low power consumption.

REFERENCE MARKS IN THE DRAWINGS

| | |
|---|---|
| 1 | PDP |
| 2 | front panel |
| 3 | front glass substrate |
| 4 | scan electrode |
| 4a, 5a | transparent electrode |
| 4b, 5b | metal bus electrode |
| 5 | sustain electrode |
| 6 | display electrode |
| 7 | black stripe (light shielding layer) |
| 8 | dielectric layer |
| 9 | protective layer |
| 10 | rear panel |
| 11 | rear glass substrate |
| 12 | address electrode |
| 13 | underlying dielectric layer |
| 14 | barrier rib |
| 15 | phosphor layer |
| 16 | discharge space |
| 81 | first dielectric layer |
| 82 | second dielectric layer |
| 91 | underlying film |
| 92 | aggregated particle |
| 92a | crystal particle |

The invention claimed is:

1. A plasma display panel comprising a first substrate and a second substrate opposed to each other with a discharge space therebetween filled with a discharge gas, wherein the first substrate includes:

a display electrode;

a dielectric layer coating the display electrode; and a protective layer on the dielectric layer, wherein the second substrate includes:

address electrodes in a direction crossing the display electrode; and barrier ribs partitioning the discharge space, wherein the protective layer on the dielectric layer includes an underlying film and a plurality of aggregated particles, each of the aggregated particles being formed by a plurality of piled up crystal grains of magnesium oxide, wherein each of the aggregated particles is separately-placed and adhered on the underlying film, wherein the underlying film contains metal oxides composed of at least two oxides selected from magnesium oxide, calcium oxide, strontium oxide, and barium oxide, and wherein according to an X-ray diffraction analysis of a surface of the underlying film, in a specific plane direction, the metal oxides have a diffraction angle peak between a minimum diffraction angle and a maximum diffraction angle of simple substances of the metal oxides in the specific plane direction.

* * * * *